United States Patent [19]

Reindel

[11] Patent Number: 4,990,871

[45] **Date of Patent: * Feb. 5, 1991**

[54] VARIABLE PRINTED CIRCUIT WAVEGUIDE FILTER

[75] Inventor: John Reindel, San Diego, Calif.

[73] Assignee: The United States of America as represented by the Secretary of the Navy, Washington, D.C.

[ * ] Notice: The portion of the term of this patent subsequent to Jan. 30, 2007 has been disclaimed.

[21] Appl. No.: 236,695

[22] Filed: Aug. 25, 1988

[51] Int. Cl.[5] ..... H01P 1/20

[52] U.S. Cl. ..... 333/209

[58] Field of Search ..... 333/209, 208, 205, 204, 333/212

[56] References Cited

U.S. PATENT DOCUMENTS 4,716,625 8/1988 Sharma ..... 333/209

4,897,623 1/1990 Reindel ..... 333/208

FOREIGN PATENT DOCUMENTS 2538958 7/1984 France ..... 333/209

OTHER PUBLICATIONS

Microwave Transmission Circuits, Ragan, pp. 513–516 (1948).

*Primary Examiner*—Gregory C. Issing

*Attorney, Agent, or Firm*—Harvey Fendelman; Thomas Glenn Keough

[57] ABSTRACT

The position of a printed circuit filter array is mechanically moved from the sidewall to the center of the waveguide to thereby tune the cut-off frequency of the waveguide. An array of printed circuit elements is placed in the E-plane inside a waveguide and serves as a high pass filter. The printed circuit elements make no contact with the guidewalls that are suspended on a dielectric substrate. A sidewall screw tuner is mechanically coupled through the waveguide wall to the dielectric substrate to physically move the dielectric substrate containing the filter elements to selected positions within the waveguide. The substrate may be moved from a position adjacent the waveguide narrow wall wherein no variation of waveguide cut-off frequency occurs to a position at the center of the waveguide wherein the increase in the waveguide cut-off frequency is maximized.

9 Claims, 2 Drawing Sheets

FIG. 1
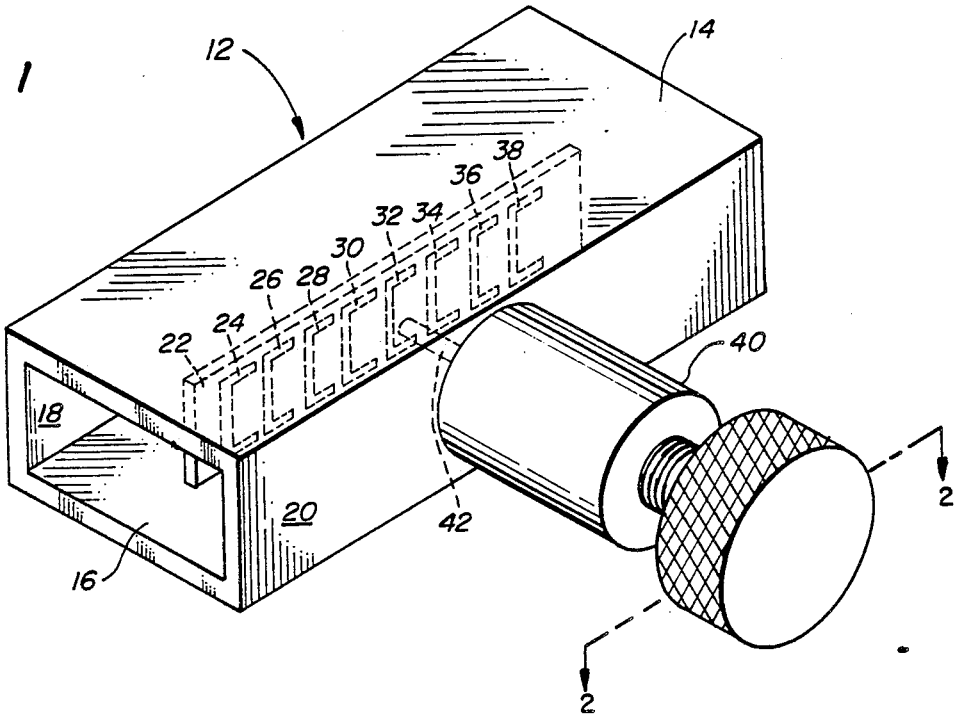
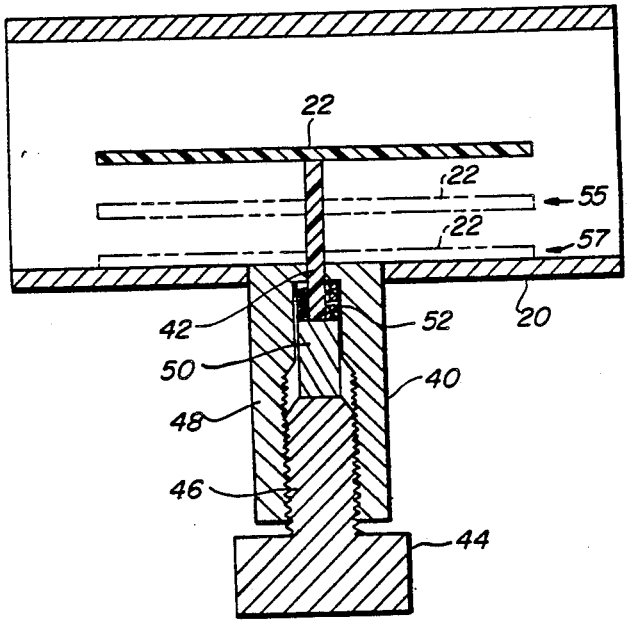
FIG. 2

VARIABLE PRINTED CIRCUIT WAVEGUIDE FILTER

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED PATENT APPLICATIONS

This application is related to co-pending U.S. patent application Ser. No. 181,126, filed Apr. 13, 1988 by John Reindel.

BACKGROUND OF THE INVENTION

The present invention relates generally to the field of waveguides and, more particularly, to waveguide filter elements and still more specifically to techniques for varying the cut-off frequency of waveguides particularly at the EHF band.

Conventional waveguide filters use elements that are in electrical and mechanical contact with the waveguide walls. Typical examples of these types of filters include inductive posts and inductive irises. These reactive elements are realized by means of metal rods or plates that are inserted into carefully machined openings and bonded to the walls of the waveguide by means of soldering, welding or compression techniques. Newer printed circuit waveguide filters also use such elements that are printed on substrates that are held suspended between the waveguide walls with firm metallic contacts at the walls. These filters, known as finline filters are simpler to make than irises and inductive posts but also require very precise machining to split the waveguide and cut the groove for supporting the substrate. Because the foregoing described type of filter elements are in contact with the waveguide walls and because currents flow in the junctions between the elements and the waveguide walls, and because of junction imperfections, the filter loss and reflection quality are often degraded.

Regardless of the element implementation technique used in prior art printed circuit filter elements, the inductive stub elements and the iris reactances both require firm contact to the waveguide walls. It is therefore nearly impossible to simultaneously vary the reactances of the filter elements. For this reason, variable filters for the EHF band are not available.

Waveguide phase shifters have been disclosed as, for instance, in *Microwave Transmission Circuits,* edited by George L. Ragan, p.p. 513–516 (1948). Such phase shifters utilize some form of screw tuning mechanisms such as sidewall screw tuners to vary the position of a long dielectric slab that extends longitudinally down the waveguide. The position of the slab may be changed laterally across the interior of the guide by utilizing the sidewall screw tuning mechanism. While such devices have been utilized in the past to cause a phase shift in the signal propagating through the section of the waveguide in which the phase shifter is utilized, it has never been suggested to utilize the screw tuning mechanism in combination with a printed circuit filter for the purpose of selectively adjusting the waveguide cut-off frequency as in the present invention.

SUMMARY OF THE INVENTION

The present invention thus comprises a mechanism for varying the propagation characteristics of a section of waveguide, namely, the cut-off frequency and that is primarily suitable for use at the EHF frequencies.

Whereas variable filters have been used at the lower microwave frequencies for many applications, tests and signal analysis and whereas receivers have employed variable filters for tuning and eliminating spurious signals, the present invention provides the first general use of variable filters at frequencies in the EHF band up through 120 GHz.

Variation of the cut-off frequency in a waveguide which propagates energy in the dominant waveguide $TE_{10}$ mode is accomplished by including a high pass filter formed on a dielectric substrate. The high-pass filter is disclosed in detail in previously referred to U.S. patent application Ser. No. 181,126 incorporated herein by reference. This printed circuit high pass filter is positioned with its longitudinal axis aligned with or parallel to the longitudinal axis of the waveguide within which it is contained. Further, a sidewall screw type tuning mechanism is mechanically connected to the printed circuit substrate for selectively varying the position of the substrate within the guide from positions adjacent one of the waveguide narrow walls to the center of the guide. In alternate embodiments of the present invention the printed circuit substrate may have a curvilinear surface with both ends of the substrate being adjacent one of the waveguide narrow walls and such that the center of the substrate is coupled to the screw type tuning mechanism. The filter can thus be selectively positioned from the center of the guide to a location adjacent one of the waveguide narrow walls and also to all positions between these two extremes.

OBJECTS OF THE INVENTION

Accordingly, it is a primary object of the present invention to disclose a mechanism for adjusting the propagation characteristics of waveguides at EHF.

A concominant object of the present invention is to disclose a mechanism for varying the cut-off frequency of waveguides.

A further object of the present invention is to disclose a mechanism which will allow the use of variable filters at frequencies up to and beyond 120 GHz.

These and other objects of the invention will become more readily apparent from the ensuing specification when taken together with the drawings.

DESCRIPTION OF THE DRAWINGS

FIG. 1 is a perspective view of the waveguide cut-off frequency adjusting mechanism of the present invention.

FIG. 2 is a top view of the mechanism illustrated in FIG. 1.

DESCRIPTION OF THE PREFERRED EMBODIMENT

Figure 3:
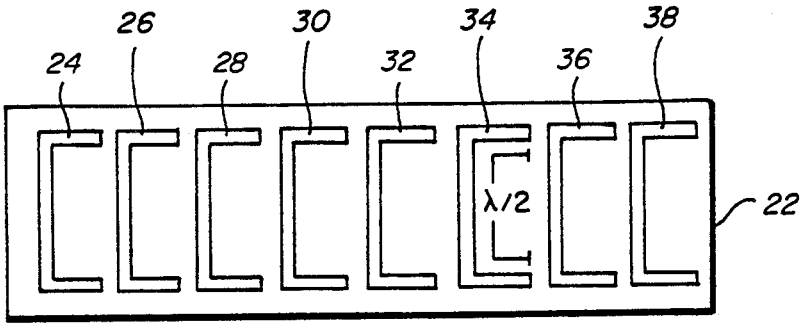
FIG. 3 is a top view of a dielectric substrate containing an array of C-shaped elements comprising a high-pass filter suitable for use in the present invention.

The present invention generally comprises a mechanism for varying the cut-off frequency of a section of waveguide 12 as is illustrated in FIG. 1. The section of waveguide 12 includes top and bottom broadwalls 14 and 16 and narrow walls 18 and 20. Positioned within the section of waveguide 12 is a dielectric substrate 22 containing an array of printed circuit elements comprising a high pass filter constructed in accordance with U.S. patent application Ser. No. 181,126 identified above. In the embodiment illustrated in FIG. 1 the high pass filter 22 an array of C-shaped conductive elements 24, 26, 28, 30, 32, 34, 36 and 38. A top view of the dielectric substrate 22 containing these C-shaped elements is illustrated more clearly in FIG. 3.

Sidewall screw tuner mechanism 40 is attached through narrow wall 20 of the waveguide 12 to the dielectric substrate 22 as would be readily understood. The sidewall screw tuner mechanism 40 includes dielectric rod 42 which extends through the sidewall 20 and is mechanically coupled to the dielectric substrate 22.

Referring to FIG. 2 the screw tuner mechanism, shown by way of example, comprises tuning knob 44 which is attached to threaded rod 46. Threaded rod 46 is in threaded mating engagement with housing 48 and is secured by suitable means to the waveguide sidewall 20. Sliding bar 50 is in mechanical contact with threaded rod 46 and also is in mechanical contact with spring 52. Dielectric rod 40 is coupled to sliding bar 50 and, as stated above, is mechanically attached to substrate 22.

As can be readily appreciated, by turning tuning knob 44 either clockwise or counter clockwise the position of substrate 22 within waveguide 12 can be varied from a location at the center of waveguide 12 illustrated in FIG. 2 through a range of positions including the intermediate position 55 and the extreme position 57 illustrated in FIG. 2 wherein dielectric substrate 22 abutts against waveguide sidewall 20.

Figure 4:
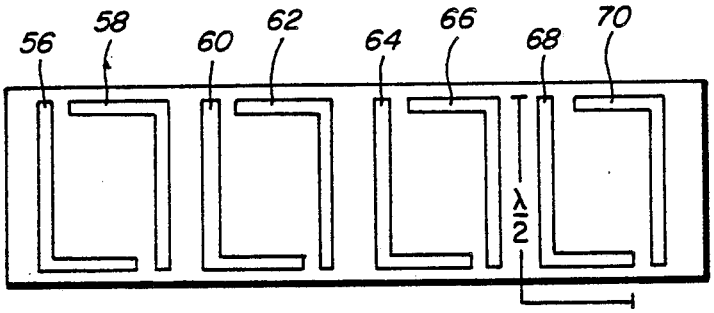
FIG. 4 is a top view of a dielectric substrate containing an array of L-shaped elements comprising a high-pass filter suitable for use in the present invention.

FIG. 4 illustrates an alternate embodiment of the high-pass filter elements which may be used in accordance with the present invention. As is shown in FIG. 4 the array of high-pass filter elements may be comprised of an array of L-shaped conductive members 56, 58, 60, 62, 64, 66, 68 and 70 which are arranged such that adjacent ones of the L-shaped elements are inverted with respect to each other as is illustrated in FIG. 4.

The electrical length of each of the C-shaped elements illustrated in FIG. 3 and the L-shaped elements illustrated in FIG. 4 should be on the order of $\lambda/2$ as is illustrated by the exemplary dimension lines in FIG. 3 and FIG. 4, where $\lambda$ is the wavelength at the midband operating frequency of the waveguide.

Figure 5:
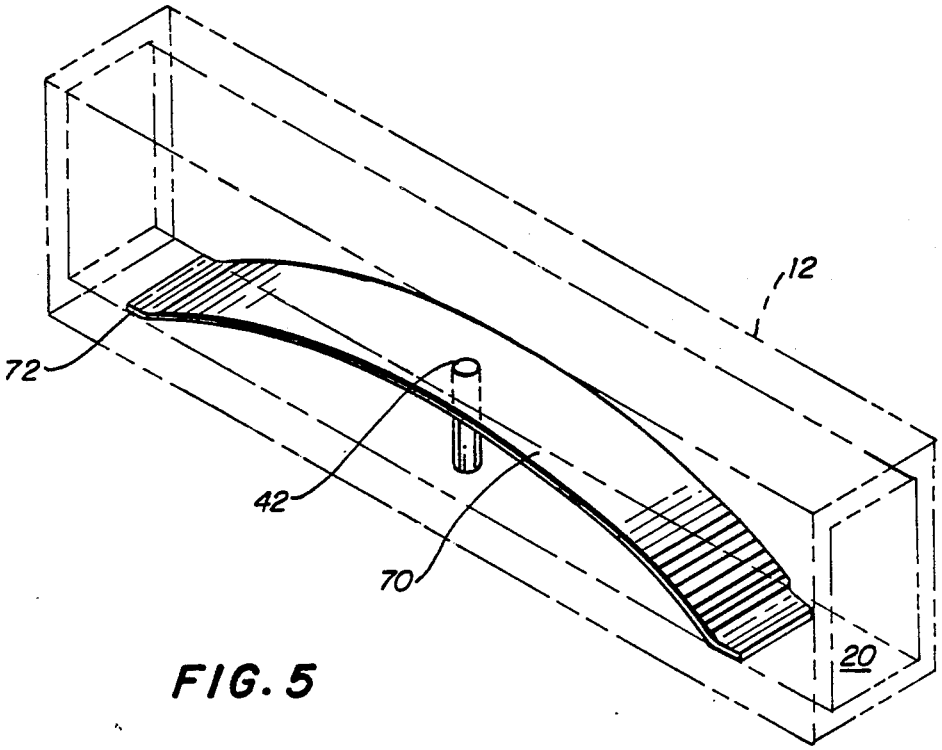
FIG. 5 is a perspective view of an alternate embodiment of the present invention wherein the dielectric substrate has a curvilinear surface.

In an alternate embodiment of the present invention, as is illustrated FIG. 5, a dielectric substrate 70 have a curvilinear surface may be utilized. In the embodiment illustrated in FIG. 5 the dielectric substrate would also contain an array of C-shaped or L-shaped high pass filter elements (not shown). Further, the dielectric substrate 70 can be affixed to the waveguide narrow wall 20 by suitable means (not shown) as by dielectric pins inserted through the walls of the waveguide to fix the position of the right hand edge of dielectric substrate 70. The screw tuner mechanism dielectric rod 42 can be affixed to the center of the curvilinear substrate 70 such that adjustment of the screw tuner mechanism causes the center of dielectric substrate 70 to move from various positions ranging from the center of the waveguide to a position adjacent the waveguide narrow wall 20 as can be readily appreciated. In this embodiment the left hand end 72 of dielectric substrate 70 will be free to slide along the narrow wall 20.

The mechanism of the present invention operates as follows. By adjusting the screw tuner mechanism 40, the position of dielectric substrate 22 can be selectively varied thereby changing the cut-off frequency of the waveguide. When the dielectric substrate 22 containing the array of high-pass filter elements is positioned near the narrow wall 20 of the waveguide, the cut-off frequency of the guide is nearly that of the waveguide since the effect of the printed circuit filter is negligible. When the dielectric substrate 22 is positioned at the other extreme, i.e. at the center of the waveguide, the array of filter elements determine the passband frequencies of the waveguide.

Obviously, many modifications and variations of the present invention are possible in the light of the above teachings. It is therefore to be understood that within the scope of the appended claims the invention may be practiced otherwise than as specifically described.

I claim:

1. An apparatus for selectively varying the cutoff frequency of energy propagating in the dominant waveguide $TE_{10}$ mode in a waveguide having first and second broadwalls connecting first and second narrow walls comprising:

filter means for filtering signals propagated in said waveguide propagation mode comprising:

a dielectric substrate having a surface plane that is oriented orthogonally to said waveguide broadwalls, a plurality of conductive elements lying in said surface plane of said dielectric substrate, there being no conductive contact between said conductive elements and said waveguide walls, each of said conductive elements having a length of approximately $\lambda/2$ where $\lambda$ is the wavelength at the operating frequency of said waveguide; and means for selectively varying the position of said dielectric substrate between said first and second narrow walls.

2. The apparatus of claim 1 wherein the dimensions of said waveguide first and second broadwalls and said first and second waveguide narrow walls are suitable for propagating energy in the 30 to 300 GHz band.

3. The apparatus of claim 1 wherein:

each of said conductive elements is generally C-shaped.

4. The apparatus of claim 1 wherein:

each of said conductive elements is generally L-shaped.

5. The apparatus of claim 4 wherein:

said plurality of generally L-shaped conductive elements are arranged in a series in which adjacent ones of said elements are inverted with respect to each other.

6. The apparatus of claims 1, 3, 4 or 5 wherein:

said dielectric substrate has a curvilinear surface.

7. The apparatus of claim 6 wherein said means for selectively varying comprises a sidewall screw tuner.

8. The apparatus of claims 1, 3, 4 or 5 wherein:

said dielectric substrate has a planar surface.

9. The apparatus of claim 8 wherein said means for selectively varying comprises a sidewall screw tuner.

* * * * *